United States Patent [19]

Links et al.

[11] 4,271,807

[45] Jun. 9, 1981

[54] PUMP/NOZZLE FOR INTERNAL COMBUSTION ENGINES

[75] Inventors: Heinz Links, Baiersbronn; Odon Kopse; Ewald Eblen, both of Stuttgart, all of Fed. Rep. of Germany

[73] Assignee: Robert Bosch GmbH, Stuttgart, Fed. Rep. of Germany

[21] Appl. No.: 966,542

[22] Filed: Dec. 5, 1978

[30] Foreign Application Priority Data

Jan. 25, 1978 [DE] Fed. Rep. of Germany ..... 2803049

[51] Int. Cl.[3] ..... F02M 57/02; F02M 59/34

[52] U.S. Cl. ..... 123/506; 123/467

[58] Field of Search ..... 123/139 AK, 139 AT, 123/139 AF, 139 DP

[56] References Cited

U.S. PATENT DOCUMENTS

| | | | |
|---|---|---|---|
| 2,792,259 | 5/1957 | Shallenberg | 123/139 AT |
| 3,677,256 | 7/1972 | Regneault | 123/139 AF |
| 3,782,864 | 1/1974 | Perr | 123/139 AK |
| 4,036,192 | 7/1977 | Nakayama | 123/139 DP |
| 4,092,964 | 6/1978 | Hofer | 123/139 AT |

FOREIGN PATENT DOCUMENTS

| | | | |
|---|---|---|---|
| 818886 | 10/1951 | Fed. Rep. of Germany | 123/139 AK |
| 2558699 | 7/1977 | Fed. Rep. of Germany | 123/139 AT |
| 2558789 | 7/1977 | Fed. Rep. of Germany | 123/139 AT |

*Primary Examiner*—Charles J. Myhre
*Assistant Examiner*—Carl Stuart Miller
*Attorney, Agent, or Firm*—Edwin E. Greigg

[57] ABSTRACT

A pump/nozzle for internal combustion engines is proposed wherein the hydraulically driven pump piston is braked in its motion after the pressure line leading to the injection valve is closed. The braking is effected after delivery is ended by means of the fuel which is forced out of an end section of the pump work chamber which serves as a filling chamber. Braking or damping occurs with a delay by means of a throttle apparatus, and in a further embodiment, braking occurs simultaneously with the relief, to a lower standing pressure level of the pressure line.

6 Claims, 6 Drawing Figures

PUMP/NOZZLE FOR INTERNAL COMBUSTION ENGINES

BACKGROUND OF THE INVENTION

The invention relates to a pump/nozzle of the type in which the pump piston is brought to a halt by means of the fuel enclosed in the filling chamber after the pressure line leading to the injection valve is closed, this closing operation thus determining the end of fuel delivery. The enclosed fuel thereby acts in a disadvantageous manner as a relatively rigid counterforce. Thus, there is the danger that the pump piston may rebound and reopen the pressure line, and thereby cause unintended after-injections of fuel from the nozzle.

The known pump/nozzle is further provided with a relief channel arranged in the pump piston which furnishes a connection of the pressure line to a chamber of lower pressure, this connection being established at least substantially at the same time as the closing of the pressure line leading to the injection valve which is controlled by the frontal control edge at the end of delivery. By means of this connection, the pressure line is relieved to the level of the pressure in a return line, this level being provided by the pre-supply pump pressure. Accordingly, this action leads to a more rapid closing of the fuel injection valve. In a known pump/nozzle this relief action determines the end of fuel injection and only after this action is the connection to the pressure line blocked by the control edge on the frontal face of the pump piston and the pump piston is then braked. If this relief action is at the level of a very low standing pressure, in the vicinity of the supply pump pressure, then the pressure drop in the pressure line will take place more rapidly than the valve needle can close, and combustion gases can get into the nozzle openings of the injection valve, which can lead to their carbonization and to functional disturbances such that the injection valve may fail entirely. By means of the lowering of pressure in the pump work chamber before the pressure line is closed, the pressure in the adjacent filling chamber as well is lowered to the extent that no further usable damping effect on the end of the stroke motion of the pump piston is possible.

With pump/nozzles of similar design it is further possible to hinder the flow of fuel, which is forced out of the space between the servo piston and the pump piston before the end of pump delivery in such a manner that a motion damping occurs. However, since this motion damping takes place during the last measure of the delivery stroke, then the end of fuel injection is simultaneously postponed, which prevents the rapid needle closing required for modern engines. This postponement of the end of injection results in a corresponding worsening of the exhaust gas values, even without any consideration of a higher fuel consumption and unfavorable noise build-up.

OBJECT AND SUMMARY OF THE INVENTION

The pump/nozzle of this invention has the advantage, because of the throttle-apparatus-controlled, delayed release of the fuel from the filling chamber, that the motion arrest of the pump piston is damped in such a way that both a too-sudden stop with an ensuing rebounding motion of the pump piston and an undamped collision of the front face of the pump piston with the end of the pump work chamber are prevented.

In accordance with the teaching of this invention, no additional structural space is required for the throttle apparatus, if it is embodied as a portion of a damping channel arranged within the pump piston, the channel being provided with a flow throttle which is preferably adjustable. The course of the damping stroke over a period of time may be controlled in a particularly advantageous way, if the flow throttle is embodied by the cross-sectional surfaces of a transverse bore of a relief channel arranged in the pump piston and of the return channel, which cross-sectional surfaces slide past each other during the stroke motions of the pump piston, and further when at least one of these cross-sectional surfaces has a shape which diverges from the circular, by which means the throttling is controllable independently of the stroke, in accordance with the mathematical relationships which derive from the cross-sectional course.

In pump/nozzles embodied with a relief channel arranged in the pump piston which furnishes a connection of the pressure line to a chamber of lower pressure, this connection being established at least approximately at the same time as the closing of the pressure line leading to the injection valve which is directed by the control edge of the front face at the end of delivery, the throttle apparatus may be included in the smallest space without an additional expenditure of structural space, if the damping channel arranged within the pump piston and the relief channel discharge into an annular groove on the pump piston which communicates with the return channel after the end of fuel injection.

If the pump piston diameter is so small that two channels cannot be included within the pump piston, then according to the invention only the damping channel is guided within the pump piston and the relief channel is cut as a longitudinal groove into the piston outer surface, whereby the longitudinal groove, in order to maintain the function, discharges into a particular annular groove. By means of the arrangement of a further annular groove on the pump piston, both annular grooves can, in the embodiment with two channels within the pump piston as well, be connected to separate return channels, each of which is connected with different chambers of lower pressure, the chambers having a particularly favorable counter-pressure both for the purpose of damping and for the purpose of pressure relief. If the damping channel is connected with a space which is under relatively high servo pressure, then a correspondingly strong damping effect can be controlled, while the relief channel, which is lowered to the level of tank pressure or is subject to the pre-supply pump pressure, enables a sufficiently great pressure difference for a rapid relief.

In a pump/nozzle provided with a relief channel, the delayed braking of the pump piston is accomplished in that a flow throttle serves as the throttle apparatus, this flow throttle being comprised of a throttle cross-sectional area which varies in accordance with the stroke and is arranged between an end section of the pump piston, which is in proximity to the frontal control edge, and the cylinder wall of the filling chamber. By this means fuel that leaves the filling chamber is forced out via the relief channel to the chamber of lower pressure. This arrangement avoids having additional channels in the pump piston, so that the dead space of the pump work chamber can be kept very small. A premature pressure drop in the pump work chamber which reduces the damping motion of the pump piston is avoided since the relief channel can be opened only after the pressure line is closed. In an advantageous manner the throttle cross-sectional area is formed by throttle grooves which cooperate with the cylinder wall of the filling chamber, with these grooves being cut into the end section of the pump piston, and adapted to extend from the frontal control edge. The throttle grooves on the one hand have various lengths in order to adjust the damping action or on the other hand they may have a cross-sectional area which becomes smaller as it moves farther away from the filling chamber.

If the fuel which escapes from the pressure line during relief and from the filling space during the remaining stroke of the pump piston is led into a chamber on the rear side of the valve needle of the fuel injection valve for the purpose of raising the closing pressure, and, if it can then first flow off via a throttle point to the chamber of lower pressure, then both a more accelerated closing of the valve needle and a boosted damping action of the remaining stroke of the pump piston is accomplished in a simple and advantageous manner.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
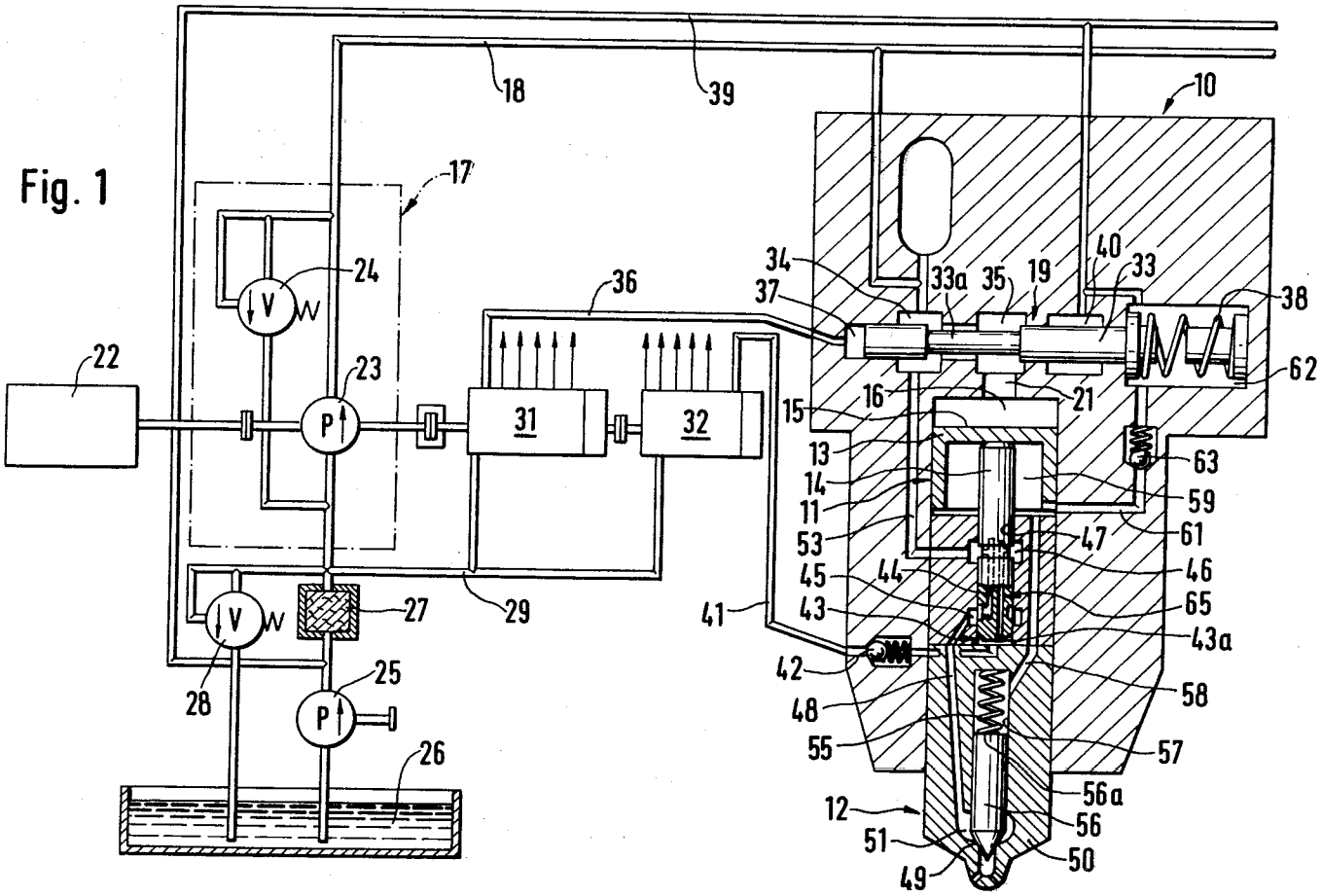
FIG. 1 shows a pump/nozzle generally in cross section correlated with a simplified representation of a fuel injection apparatus.

Turning now to FIG. 1, there will be seen a high pressure fuel injection system including the first exemplary embodiment of a pump/nozzle assembly 10 which consists substantially of a hydraulically driven piston pump 11 and an injection nozzle 12 embodied as a pressure-controlled injection valve. In a known manner, the pump 11 is embodied as a servo pump, i.e., it includes a servo piston 13 and a pump piston 14, together constituting a differential piston. The face 15 of the servo piston 13 movably defines one wall of a servo pressure chamber 16 to which is admitted fuel under servo pressure ($P_S$) coming from a pressure source 17 via a supply line 18, a switching valve 19 and a control port 21.

The pressure source 17 generating the servo pressure consists substantially of an adjustable servo pressure pump 23 driven by a motor 22 and including a pressure-limiting or control valve 24. The servo pressure pump 23 is fed by a low pressure pump 25 which serves as a pre-supply pump, which aspirates fuel from a tank 26 through a filter 27 and delivers it to the servo pressure pump 23. The supply pressure of the low pressure pump is limited by a further pressure limiting valve 28. A branch line 29 supplies fuel to pressure distributors 31 and 32.

The switching valve 19 is embodied as a sliding spool valve and the control slide 33 moves in the top of the pump nozzle assembly 10 where it is illustrated in its normal position, i.e., when the nozzle is closed. In that position, the slide 33 connects the servo pressure chamber 16 with the servo pressure supply line 18 by permitting communication between a first annular chamber 34 and a second annular chamber 35 via a region of reduced diameter **33*a*. The control slide 33 may be axially moved, in particular into its second position, not shown, by a pressure control pulse produced by the pressure unit 31 in synchronism with the speed of the motor 22. This control pressure is fed via a line 36 to a control pressure chamber 37. In the second position of the control plunger 33, communication is established between the servo pressure chamber 16 through the control port 21, the annular chamber 35, the reduced region 33*a* and the third annular chamber 40 of the valve 19. The annular chamber 40 is connected to a return line 39 which terminates in the junction between the supply pumps 25 and 23 and thus experiences the pressure of the low pressure pump 25. It will be understood that the return line 39 could also be terminated in the tank 26** where atmospheric pressure prevails.

The pressure unit 31 may be a known rotary distributor or a piston pump or a solenoid controlled mechanism which permits movement of the control plunger 33 into its illustrated position by relieving the pressure in the chamber 37, thereby initiating the injection process as servo fuel is fed into the servo pressure chamber 16. The second pressure unit 32 is a fuel metering system connected through a filling line 41 and the filling valve 42 with a pump work chamber 43 defined by the pump piston 14. The fuel metering system could also be any suitable injection pump driven as illustrated by the motor 22. Both pressure units 31 and 32 will not be further described because they are not directly involved in the subject of the present invention.

In the illustrated position of the pump piston 14 after its pumping stroke is ended, the connection from the work chamber 43 to the injection nozzle 12 is interrupted. However, a relief channel 44 within the pump piston 14 permits communication between annular chambers 45 and 46 defined within the wall of the cylinder 47. The annular chamber 45 communicates through a pressure channel 48 embodied as a longitudinal bore with a pressure chamber 51 adjacent to the valve seat 49 within the nozzle housing 50. The annular chamber 46 is coupled via a return channel 53 to the annular chamber 34 of the switching valve 19 which is under servo pressure. Thus, in the illustrated position of the pump piston 14, the pressure chamber 51 in the nozzle 12 is relieved to the servo pressure level $P_S$ prevailing in the supply line 18.

In a known manner, the valve seat 49 of the injection nozzle 12 is closed between injection intervals by a valve needle 56 which is urged toward the valve seat by a closing spring 55. This closing spring 55 is prestressed, when the pressure chamber 51 is relieved to servo pressure, such that the closing pressure, and thus the opening pressure as well, on the injection nozzle 12 are above the servo pressure.

A chamber 57 which contains a spring 55 is connected by means of an oil drainage line 58 with a pressure-relieved chamber 59 between servo piston 13 and pump piston 14 and further connected from there via a line 61 and a chamber 62 which includes the spring 38 of the switching valve 19 with the return line 39. A ball valve 63 inserted into the line 61 is intended to prevent a reinduction of fuel from the return line 39 into the chamber 59. It will be noted that the spring 55 is supported on the end 56*a* of the valve needle 56.

So that the pump piston 14, when it reaches the end of its stroke as shown in FIG. 1, does not forcefully strike the valve housing 50 of the injection nozzle 12, its remaining stroke, which takes place after the connection between the pump work chamber 43 and the pressure line 48 is closed, is damped with a delay by means of a throttle apparatus 65. This essential feature of the invention will now be described in detail with reference to FIG. 2.

Figure 2:
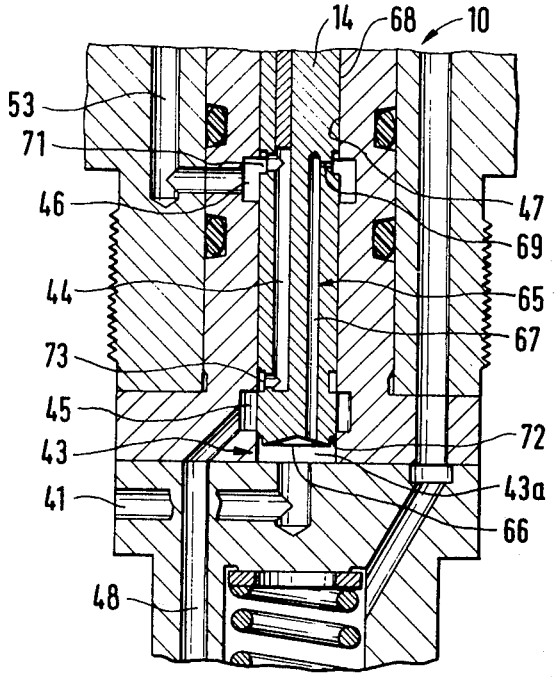
FIG. 2 shows an enlarged fragmentary cross-sectional view of a detail of the pump/nozzle of FIG. 1.

As the enlarged detail in FIG. 2 of a practical embodiment according to FIG. 1 shows, the pump piston 14 contains in addition to the relief channel 44 the throttle apparatus 65, which is embodied in the form of a damping channel. This throttle apparatus 65 comprises a longitudinal bore 67 which extends from the front face 66 of the pump piston 15 (see FIG. 1) and a transverse bore 69 extending perpendicular to the bore 67 and emptying into the jacket surface 68 which encompasses the pump piston 14. The transverse bore 69 is embodied as a narrow throttle bore and thus serves as a flow throttle. An adjustment of this flow throttle with respect to its throttle resistance can be accomplished by means of varying the degree of overlap of the transverse bore 69, or by means of an interchangeable screw insert (not shown) which is provided with the flow throttle 69. The transverse bore 69 which serves as the flow throttle empties into an annular groove 71 that is cut into the jacket surface 47 of the pump piston 47. The groove 71 serves at the same time as the emptying point for the relief channel 44 and communicates via the annular chamber 46 with the return channel 53 in the illustrated position of the pump piston 14.

In a departure from FIG. 1, the pump piston 14 of FIG. 2 is in a position which it assumes at the end of injection after the connection between pump work chamber 43 and the pressure line 48 has been closed by means of a control edge 72 on the front face. In this position which determines the end of fuel delivery, the control edge may be, for example, approximately 0.1 mm deeply inserted into an end section 43*a* of the pump work chamber 43, which serves as a filling chamber that is supplied with fuel via the filling line 41. At the same time the lower limiting edge of a second annular channel or recess 73 that is cut into the jacket surface 68 of the pump piston 14 is in alignment with the upper limiting edge of the annular chamber 45, and when the pump piston 14 makes a further downward movement this produces a connection from the pressure line 48, which leads to the pressure chamber 51 (see FIG. 1) of the injection nozzle 12, to the relief channel 44. In this way the relief does not take place before the pump delivery is ended, yet does take place before the end of fuel injection, because a premature relief leads to a postponement of the end of fuel injection and to a premature lowering of the fuel injection pressure.

Since during the entire fuel injection stroke the filling valve 42 (see FIG. 1) is closed, the fuel which is contained within the filling chamber 43*a*, after the connection between the pump work chamber 43 and the pressure line 48 is closed by means of the control edge 42, can only flow out via the damping channel 65, with a delay caused by the flow throttle 69, to the return channel.

By means of a corresponding mutual adjustment of the bore diameter, the channels, the flow throttle 69, the remaining stroke of the pump piston 14 and the counterpressure prevailing in the return channel 53, a precisely dosed damped motion of the pump piston 14 can be controlled during its remaining stroke.

This throttle apparatus 65 can also be employed with pump pistons which do not have a relief channel 44. If, however, as in the illustrated example, such a relief channel 44 is present, then this channel must not be opened before the end of the pump delivery, as has already been described, in order to ensure that the fuel which is enclosed within the filling chamber 43*a* during the remaining stroke of the pump piston 14 is subject to injection pressure and that because of this very high level of pressure a delayed and correspondingly controllable damping can be effectively employed.

Figure 3:
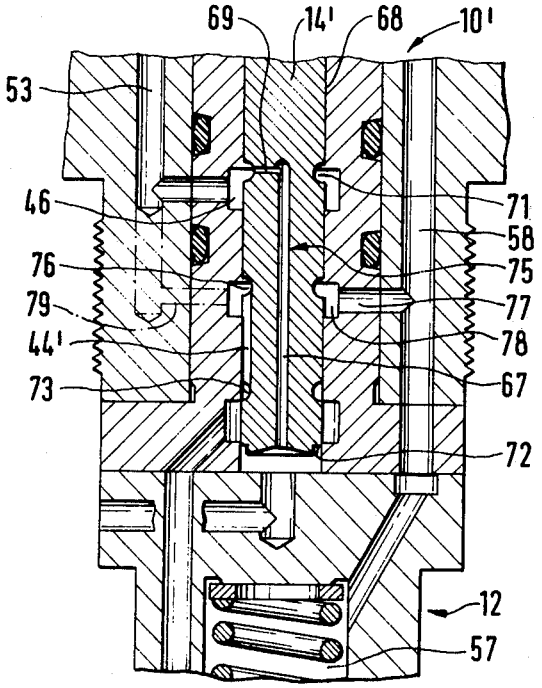
FIG. 3 is a further enlarged fragmentary cross-sectional view of a modified version of FIG. 2.

FIG. 3 shows the second exemplary embodiment of a pump/nozzle 10' which as in FIG. 2 is shown as an enlarged detail of the whole device. In this embodiment of the invention, corresponding parts are given a reference numeral with a prime, while those elements which remain the same have the same reference numeral. This pump/nozzle 10' differs from the first exemplary embodiment of FIGS. 1 and 2 only in that it has a slightly altered throttle apparatus 75 and an arrangement of the relief channel which is particularly favorable for pump pistons of small diameter. The pump piston 14' is in the same position as that shown in FIG. 2, that is, after the pump delivery has ended and before the relief has begun. The longitudinal bore 67 of the throttle apparatus 75, which is embodied as a damping channel as in the first exemplary embodiment, is machined into the pump piston 14' substantially in the middle thereof and is connected with the annular groove 71 via the flow throttle 69.

In lieu of the transverse bore 69 which is embodied as a flow throttle and discharges into the annular groove 71, this bore may discharge directly into the area of the jacket surface 68 of the pump piston 14' and may form a flow throttle, together with the annular chamber 46 or a correspondingly shaped attachment point for the return channel 53, which is variable in accordance with the stroke. (This possible embodiment is not illustrated.) By means of a corresponding shaping of the cross-sectional surfaces of the discharge of the transverse bore 69 and the connection point of the return channel 53, which slide past each other during a stroke movement of the pump piston 14', the course of the damping stroke over a period of time can be controlled. Thus, for example, the discharge of the transverse bore 69 may be embodied as a slot element with parallel or oblique lateral limitation edges and the connection point of the return channel may be circularly embodied, in which case, however, the pump piston 14' would require a rotary alignment.

If the annular channel 46 is maintained as the connection point for the return channel 53, then the rotary alignment of the pump piston is of no consequence to its operation.

The relief channel 44' in FIG. 3 is embodied as a longitudinal groove cut into the piston jacket surface 68 and proceeding from the annular groove 73 it discharges into an annular groove 76, which is at an axial distance from the first annular groove 71 which forms the discharge for the damping channel 75 and at the same time is at a lesser distance from the frontal control edge 72 than is the annular groove 71. In the illustrated position of the pump piston 14', the annular groove 76 communicates with a second return channel 77, which has an annular chamber 78 as a discharge disposed in the wall of the pump cylinder 47 and thus communicates with the oil drainage line 58. The oil drainage line 58 which drains oil from the spring chamber 57 of the injection nozzle 12 is subject, as was already described in connection with FIG. 1, to the pressure of the pre-supply pump 25 which amounts to only a few bar, or when the oil drainage return line 39 (see FIG. 1) is connected directly with the tank, it is subject to atmospheric pressure. By means of this spaced-apart connection of the relief channel 44' and the damping channel 75 with chambers of differing pressure levels, the two processes of stroke damping and the relief of the pressure chamber 51, shown in FIG. 1, at the nozzle 12 have no reciprocal influence and can be optimally adjusted each to the other. If the injection nozzle 12 is supposed to be pressure-relieved to the level of the servo pressure as well, then the return channel 77 is omitted and the annular chamber 78 is connected, as is shown in dot-dash lines, by means of a connecting line 79 with the elongated return channel 53. In order to avoid thereby an excessive prestressing of the closing spring 55, the spring chamber 57 may also be connected to the annular chamber 46 which is under pressure (which is not shown), instead of being connected as shown to the return line 39 via the lines 58 and 61 (see FIG. 1).

Figure 4:
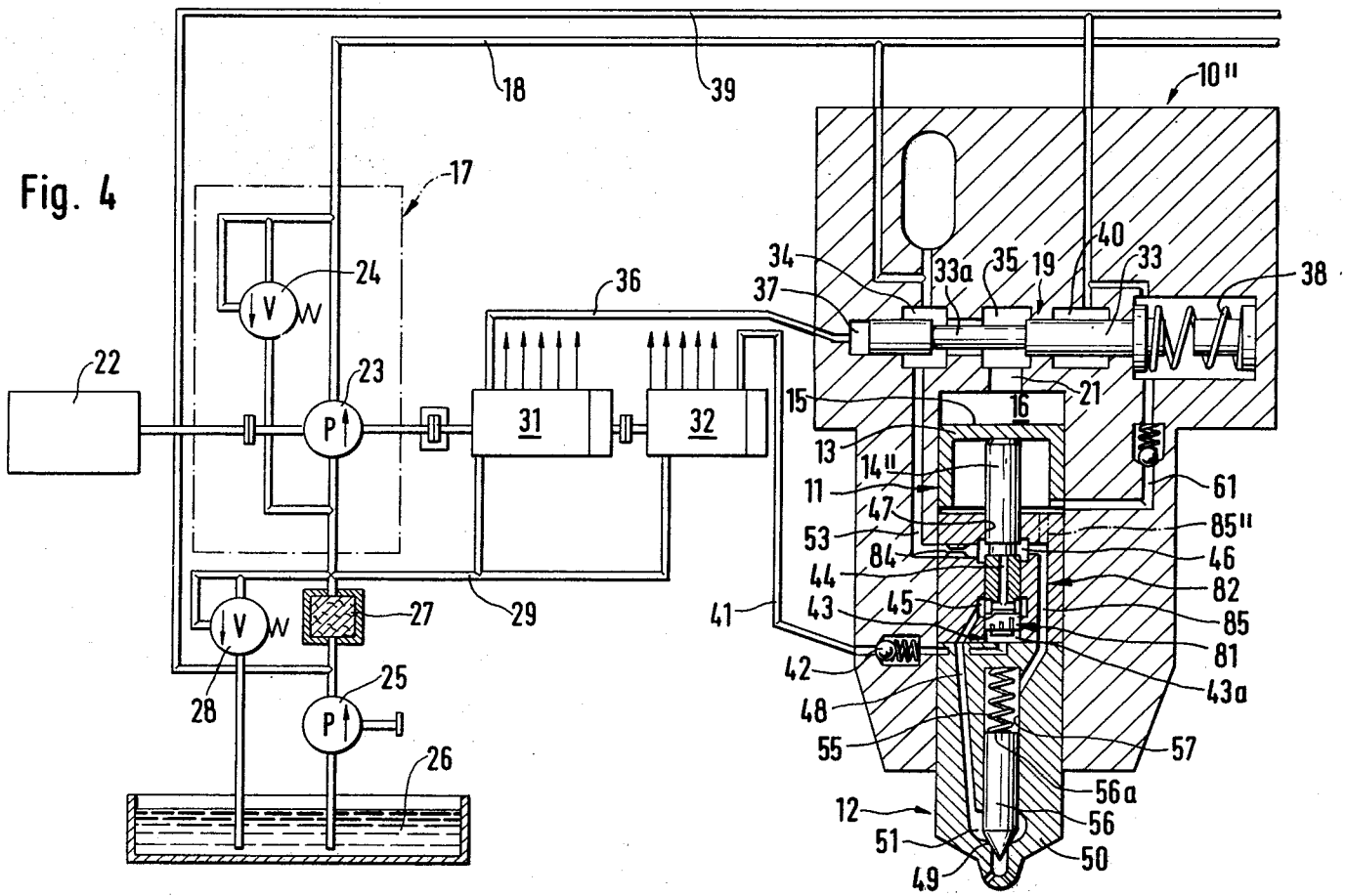
FIG. 4 shows a further embodiment of a fuel injection apparatus of the type generally shown in FIG. 1.

The high-pressure fuel injection apparatus of FIG. 4 contains the third exemplary embodiment of a pump-/nozzle 10'' in accordance with the invention. The pressure source 17 and the pressure units 31 and 32 are the same as those described in connection with FIG. 1. The pump/nozzle 10'' essentially differs from the pump-/nozzles 10 and 10' by having an altered embodiment of the throttle apparatus, here given the reference numeral 81, and by having an additional apparatus 82 for the purpose of elevating the closing pressure.

The essential characteristics of the invention in the pump/nozzle 10'' are more clearly seen in FIG. 5, and will now be described in more detail by referring to this figure. In order to damp the remaining stroke of the pump piston 14'' with a delay in accordance with the teaching of this invention, a flow throttle 81 serves as the throttle apparatus which is produced by the grooves 83 which cooperate with the cylinder wall of the filling chamber **43*a*. Throttle grooves 83 are cut into the end section 14*a*'' of the pump piston 14'', and begin in close proximity to the frontal control edge 72. Thus, it is to be understood that the throttling action is provided by means of the throttle cross-section which the grooves form with the cylinder wall during the remaining stroke of the pump piston 14''. The groove 83 has a differing length L, by which means the course of the throttle effect over a period of time can be preset during the remaining stroke of the pump piston 14''. In place of variably long grooves, variably deep grooves may also be cut into the jacket surface of this piston section 14*a*''. The throttle grooves 83 may also be embodied with differing width or with a cross-section which becomes smaller as it moves farther away from the filling chamber 43*a*. After the connection from pump work chamber 43 to the pressure line 48 is closed, the fuel contained in the filling chamber 43*a* is forced out into the annular chamber 45 because the effective cross-sectional area of the throttle grooves 83 becomes continuously smaller. The fuel flows out of the the annular chamber 45 via the relief channel 44, which has been opened in the meantime, and travels into the annular chamber 46, which communicates with the return channel 53 via a throttle point 84** which comprises a narrow bore.

However, before the fuel enters the return channel 53, it is directed into the apparatus 82 toward the injection nozzle and thereby serves to increase the closing pressure. The apparatus 82 consists substantially of a connecting channel 85 which connects the annular chamber 46 with the spring chamber 57 of the injection nozzle 12. The fuel which is forced out of the filling chamber **43*a* and which flows, during the relief process, out of the pressure line 48, is then directed through the channel 85. Thus, the fuel, which is briefly prevented by the throttle 84 from flowing out into the return channel 53, causes a rise in pressure in the spring chamber 57 and thereby effects an increase in closing pressure on the upper surface 56*a* of the valve needle 56 by lending support to the closing force of the valve spring 55. (This may also be seen by referring to FIG. 4**.)

If the fuel which is delivered from the pressure source 17 (see FIG. 4) via the supply line 18 is regulatable as to its pressure level, then this pressure is also effective in the spring chamber 57 of the injection nozzle 12, so that the opening pressure of the injection nozzle is likewise capable of being regulated.

Referring again to FIG. 5, the damping motion of the pump piston 14'' by means of the flow throttle 81 according to the present invention can naturally also attain complete effectiveness even if the pump/nozzle is not provided with an apparatus 82 to increase the closing pressure. In this case, the annular chamber 46 is connected directly with the return channel 53 via the throttle 84 which serves as a setting throttle. The connection from the annular chamber 46 to the channel 85 is interrupted and then connected, as is shown at 85'' in FIG. 4 with dot-dash lines, via the line 61 to line 39, so that this channel 85'' serves as an oil drainage channel in the same manner as the channel 58 in FIG. 1.

Figure 5:
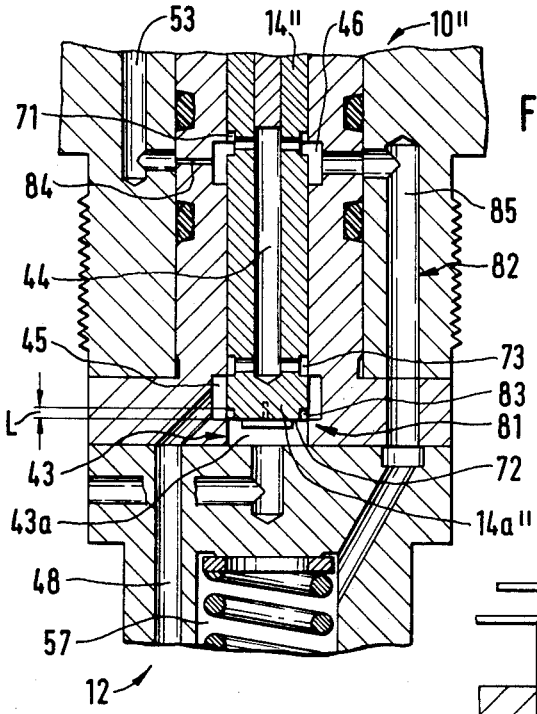
FIG. 5 shows another enlarged fragmentary view of the structure shown in the third exemplary embodiment.
Figure 6:
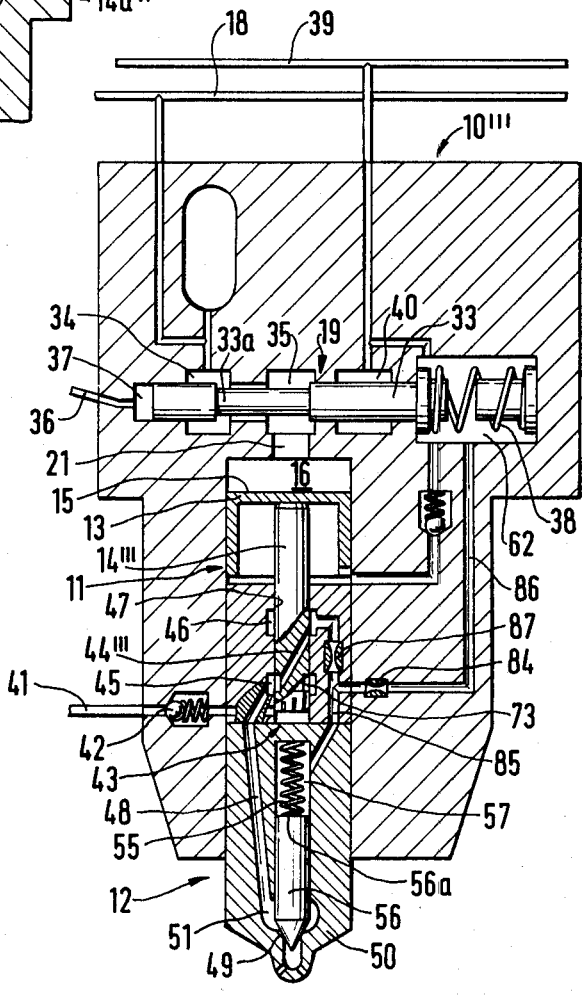
FIG. 6 shows still another enlarged fragmentary view of a simplified representation of the fourth exemplary embodiment.

The fourth exemplary embodiment shown in FIG. 6 of a pump/nozzle 10''' according to the invention differs from the pump/nozzle 10'' of FIGS. 4 and 5 only in an altered arrangement of the return channel. In this embodiment, channel 86 which includes a throttle 84 is connected to channel 85 between annular chamber 46 and spring chamber 57, as well as to a relief channel 44''' provided in the pump piston 14'''. It will be noted that the throttle means 84 is inserted between the connecting channel 85 and the return channel 86, so that at a correspondingly strong throttling action, the pressure surge which flows during the relief process from the pressure line 48 is first directed into the spring chamber 57 in order to increase the closing pressure and then flows off via the throttle 84 to the return channel 86. In this pump/nozzle 10''', the return channel 86 is connected via the chamber 62 with the return line 39, which provides the pre-supply pump pressure. As has already been described in connection with FIG. 1, this return line 39 may also lead directly to the tank and thus be relieved on tank pressure, that is, atmospheric pressure. However, to avoid the formation of bubbles, a certain counterpressure in this line 39 is advantageous, which may also be attained by means of throttling the returning fuel. The relief channel 44''' that is bored diagonally through the pump piston 14''' extends from the annular groove 73 and empties into the annular chamber 46 in the jacket surface 68 of the piston 14''' and, as a consequence, depending on the position of this emptying point the beginning or the end or, depending on the form of this emptying point, the delayed course of the relief process as well may be influenced.

A too-rapid relief process, which leads to the entry of combustion gases into the injection nozzle 12, is prevented by means of an additional throttle 87 that is inserted into the connecting channel 85, this throttle 87 being adapted to control the speed of the relief process.

The foregoing relates to preferred embodiments of the invention, it being understood that other embodiments and variants thereof are possible within the spirit and scope of the invention, the latter being defined by the appended claims.

What is claimed and desired to be secured by Letters Patent of the U.S. is:

1. In a pump/nozzle for internal combustion engines including a pump piston driven by means of a servo piston of larger diameter, said pump piston being guided in a fluid-tight manner within a cylinder bore which forms the pump work chamber, said pump piston blocking the connection from the pump work chamber to a pressure line attached in the vicinity of the wall of the cylinder bore and leading to an injection valve, said blocking taking place shortly before the end of the stroke of said pump piston, thereby terminating fuel delivery and being effected by a frontal control edge of said pump piston, whereupon, during its remaining stroke, said pump piston enters an end section of the pump work chamber serving as a filling chamber and is braked by fuel which is prevented from escaping from said filling chamber by a filling valve which is disposed in a filling line which terminates in the filling chamber and supplies the pump work chamber with the fuel which is to be injected, and having a low-pressure chamber to receive fuel from said filling chamber via a relief channel arranged within said pump piston which is opened to the pressure line at least substantially at the same time as the pressure line leading to the injection valve is closed from the pump work chamber, the improvement comprising:

throttle means, associated with said pump piston, for controlling the delayed escape of fuel from the filling chamber to a low-pressure chamber;

and wherein the relief channel is opened to the pressure line as controlled by the frontal control edge, which relief channel has a discharge point cut into the jacket surface of the pump piston in the vicinity of said frontal control edge, wherein a flow throttle defined by a throttle cross section which varies in area in accordance with the stroke and is located between an end section adjacent to said frontal control edge of said pump piston and said cylinder wall of the filling chamber so that fuel which escapes from said filling chamber via said relief channel to the chamber of lower pressure is capable of being forced out, further wherein said relief channel is first capable of being opened after said pressure line is closed.

2. A pump/nozzle in accordance with claim 1, wherein said throttle cross section is defined by means of throttle grooves which cooperate with a cylinder wall surrounding said filling chamber, are formed in an end section of said pump piston, and begin at said frontal control edge of said pump piston.

3. A pump/nozzle in accordance with claim 2, further wherein said throttle grooves have a varying length (L).

4. A pump/nozzle in accordance with claim 2, wherein said throttle grooves have a cross section which becomes smaller as it moves away from said filling chamber.

5. A pump/nozzle in accordance with claim 1, wherein said throttle cross section is defined by means of an annular throttle gap provided between said cylinder wall of said filling chamber and an end section of said pump piston.

6. A pump/nozzle in accordance with claim 5, wherein said end section of said pump piston has a diameter which becomes smaller toward said pump work chamber.

* * * * *